US009196434B2

(12) United States Patent
Chelloug

(10) Patent No.: US 9,196,434 B2
(45) Date of Patent: Nov. 24, 2015

(54) METHOD AND DEVICE FOR PERFORMING DIAGNOSTICS OF AN ACTUATOR, AND ACTUATOR COMPRISING ONE SUCH DEVICE

(75) Inventor: Mustapha Chelloug, Echirolles (FR)

(73) Assignee: Schneider Electric Industries SAS, Rueil-Malmaison (FR)

( * ) Notice: Subject to any disclaimer, the term of this patent is extended or adjusted under 35 U.S.C. 154(b) by 434 days.

(21) Appl. No.: 13/414,322

(22) Filed: Mar. 7, 2012

(65) Prior Publication Data

US 2012/0242358 A1 Sep. 27, 2012

(30) Foreign Application Priority Data

Mar. 22, 2011 (FR) ..... 11 00863

(51) Int. Cl.

| | |
|---|---|
| ***G01R 31/02*** | (2006.01) |
| ***H01H 11/00*** | (2006.01) |
| *H01H 47/00* | (2006.01) |
| *H01H 47/06* | (2006.01) |

(52) U.S. Cl.

CPC ..... *H01H 11/0062* (2013.01); *H01H 47/002* (2013.01); *H01H 47/06* (2013.01); *H01H 2300/052* (2013.01)

(58) Field of Classification Search

CPC ..... G01R 31/00; G01R 35/04
USPC ..... 324/750.01–750.02, 500–537, 547
See application file for complete search history.

(56) References Cited

U.S. PATENT DOCUMENTS

| | | | | |
|---|---|---|---|---|
| 5,784,245 | A * | 7/1998 | Moraghan et al. | 361/154 |
| 5,978,191 | A | 11/1999 | Bonniau et al. | |
| 6,002,565 | A | 12/1999 | Ronisch | |
| 6,275,368 | B1 | 8/2001 | Yamada et al. | |
| 7,619,866 | B2 * | 11/2009 | Houbre et al. | 361/93.2 |
| 2005/0285589 | A1 * | 12/2005 | Eaton et al. | 324/207.17 |
| 2006/0067024 | A1 * | 3/2006 | Chemisky et al. | 361/139 |
| 2009/0139505 | A1 | 6/2009 | Naito et al. | |
| 2009/0219033 | A1 * | 9/2009 | Schumacher et al. | 324/546 |
| 2010/0060469 | A1 | 3/2010 | Hetzmannseder et al. | |
| 2011/0270544 | A1 * | 11/2011 | Kucera et al. | 702/58 |
| 2012/0001652 | A1 * | 1/2012 | Okamura | 324/765.01 |
| 2012/0112759 | A1 * | 5/2012 | Kn et al. | 324/523 |

FOREIGN PATENT DOCUMENTS

| | | | | |
|---|---|---|---|---|
| DE | 3920693 | A1 | 1/1991 | |
| DE | 196 36 975 | A1 | 3/1998 | |
| EP | 0 944 100 | A1 | 9/1999 | |
| EP | 2 028 676 | A2 | 2/2009 | |
| FR | 2 731 838 | A1 | 9/1996 | |
| JP | 2009/174599 | | 8/2009 | |
| WO | WO 98/24106 | A1 | 6/1998 | |
| WO | WO9946783 | * | 9/1999 | H01F 7/18 |

* cited by examiner

*Primary Examiner* — Vincent Q Nguyen
(74) *Attorney, Agent, or Firm* — Steptoe & Johnson LLP

(57) ABSTRACT

A diagnostic method for an actuator having a coil and a control device for supplying power to the coil, by controlling a power supply to the actuator by a diagnostic device, controlling a supply of power to the coil by a control device, monitoring an electric signal supplying the actuator, and deriving a diagnostic indicator of the actuator from a result of monitoring; and a device and computer code for executing the method.

15 Claims, 4 Drawing Sheets

METHOD AND DEVICE FOR PERFORMING DIAGNOSTICS OF AN ACTUATOR, AND ACTUATOR COMPRISING ONE SUCH DEVICE

BACKGROUND OF THE INVENTION

The present invention relates to a method for performing diagnostic of an actuator comprising a coil and a control device of power supply of the coil, in particular an electric circuit breaker actuator. It also relates to a device for performing diagnostic of the power supply of a coil of an actuator enabling the diagnostic method to be implemented. It also relates to an actuator comprising a coil and at least one such diagnostic device. It finally relates to a computer program comprising computer program code means suitable for execution of steps of the diagnostic method.

STATE OF THE ART

Actuators designed to command opening and closing of circuit breakers are known and are nowadays formed by integrated control electronics and associated with an electromagnet coil. The role of these electronics has enabled functionalities to be added which have mainly enabled the volume of the actuator to be reduced.

These actuators were beforehand only formed by a directly supplied electromagnet, i.e. without control electronics. In certain sensitive installations, it was therefore possible to perform testing of the continuity of the coil winding by inputting a weak current to the coil. It was thus possible to have an indication of the state or the availability of the actuator. However, these means did not enable it to be determined whether the coiling of the actuator was short-circuited or not.

This monitoring means is not usable on actuators controlled by electronics—it does not give any information on the state of the actuator, but only gives information on its presence.

A requirement however exists in certain sensitive installations to know the state of the actuator, in particular:

- the state of the coil or coils, (operational or open or short-circuited), and/or
- the state of the control electronics of the coil or coils.

It therefore appears of interest to test a coil supplied by control electronics (using for example a PWM technology, PWM standing for Pulse Width Modulation, whereby the control voltage can be matched to a wide power supply range or an inrush holding operation which reduces the power dissipated in continuous holding). The supplied coil is not directly "visible" through its control and supply wires—there is generally a diode bridge and an open transistor when the coil is not commanded. A current supplying the actuator does not therefore necessarily supply the coil.

The object of the invention is therefore to check that the coil winding is not interrupted or short-circuited and that the electronics are not faulty.

Devices enabling diagnostics to be performed are known from the prior art concerning different systems such as an automobile vehicle safety system (DE 3920693) or such as an automobile vehicle ignition system (US 2009/139505). A device for diagnostic of operation of an electronic control circuit of a solenoid valve is also known from the document JP 2009/174599.

SUMMARY OF THE INVENTION

The object of the invention is to provide a diagnostic method enabling the problems brought up in the foregoing to be remedied and improving known methods of the prior art. In particular, the invention proposes a diagnostic method that is simple, economical, efficient and enables it to be checked that the coil winding is not interrupted or short-circuited and/or that the control electronics are not faulty.

A diagnostic method according to the invention of an actuator comprising a coil and a power supply control device of the coil comprises the following steps:

- Control of a power supply of the actuator by means of a diagnostic device,
- Control of a power supply of the coil by means of the control device,
- Monitoring, at the level of the diagnostic device, of an electric characteristic of an electric signal, in particular of the electric signal supplying the actuator, and
- Deduction of a diagnostic of the actuator using the result of the monitoring step.

Preferably, the step of control of a power supply of the actuator comprises activation of a power supply control means of the actuator.

Preferably, the step of control of a power supply of the coil comprises activation of a power supply control means of the coil.

Advantageously, the monitoring step, at the level of the diagnostic, of an electric characteristic of the electric signal comprises determination of an intensity of a current flowing in a power supply line of the actuator or determination of a voltage at the terminals of a resistive element through which the current flowing in a power supply line of the actuator is flowing.

Preferably, the step of deduction of a diagnostic of the actuator comprises time-based analysis of the variations of the electric characteristic.

A diagnostic device according to the invention of the power supply of a coil of an actuator comprises hardware and/or software means for implementing steps of the diagnostic method as defined above.

Preferably, the hardware and/or software means comprise control means of power supply of the actuator.

Preferably, the hardware and/or software means comprise means for monitoring an electric characteristic of the electric signal, said means being means for determining an intensity of a current flowing in a power supply line of the actuator or means for determining a voltage at the terminals of a resistive element through which the current is flowing in a power supply line of the actuator is flowing.

Preferably, the hardware and/or software means comprise means for deduction of a diagnostic of the actuator, said means being means for time-based analysis of the variations of the electric characteristic of the electric signal.

Preferably, the hardware and/or software means comprise control means of power supply of the coil.

Advantageously, the hardware and/or software means comprise means for determining an intensity of a current flowing in the coil and means for analysing the intensity of the current flowing in the coil.

Advantageously, the hardware and/or software means comprise means for determining a supply voltage of the coil and means for analysing the power supply voltage of the coil.

An actuator according to the invention comprising a coil and at least one control device comprises a diagnostic device as defined above.

Preferably, the diagnostic device is composed of two separate devices, the first diagnostic device and a second control device.

A computer program according to the invention comprises computer program code means suitable for execution of steps of the method as described in the foregoing, when the program is executed on a computer.

BRIEF DESCRIPTION OF THE DRAWINGS

The appended drawings represent for example purposes an embodiment of a diagnostic device according to the invention, two embodiments of a control device according to the invention and a mode of execution of the diagnostic method according to the invention.

DETAILED DESCRIPTION OF PREFERRED EMBODIMENTS

Figure 1:
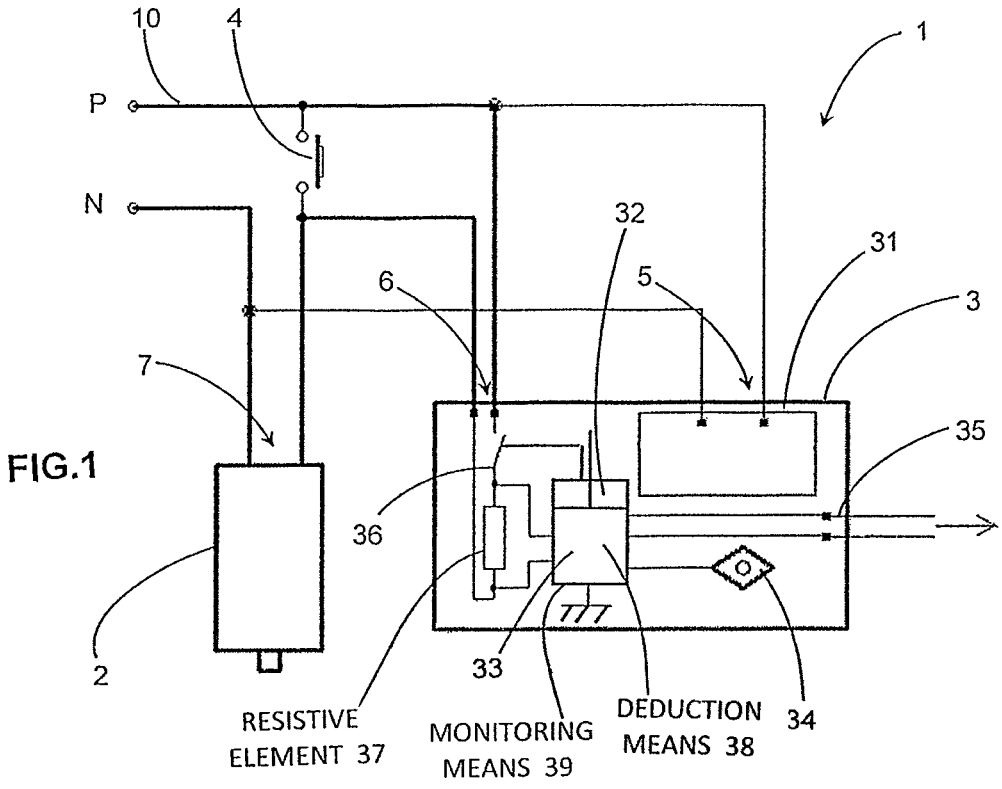
FIG. 1 is a diagram of a system comprising an embodiment of a diagnostic device according to the invention.

An embodiment of a system 1 according to the invention is described in the following with reference to FIG. 1. This system mainly comprises an actuator 2, in particular an electric circuit breaker actuator, a diagnostic device 3 of the state of the actuator and an activation switch 4 of the actuator 2, such as a pushbutton.

For example, the actuator 2 is connected in series with the switch 4 on an electric line 10 between the phase terminal P and neutral terminal N of an electric power system, such as the commercial power grid. The power supply, and therefore activation of the actuator, is therefore controlled by the switch 4. Actuation of the switch in fact results in the power grid voltage being applied directly to the terminals 7 of the actuator.

The diagnostic device 3 is further connected by power supply terminals 5 directly to the phase terminal P and neutral terminal N of the power system. The diagnostic device is further connected by terminals 6 to the terminals of the switch 4, i.e. in parallel to the switch. Consequently, to implement a diagnostic method, the diagnostic device enables power supply of the actuator by short-circuiting the switch.

Alternatively, the diagnostic device could supply the actuator by applying a voltage generated by the diagnostic device directly between the terminals 7 of the actuator.

Power supply of the actuator via the diagnostic device is performed periodically, for example once per hour, in particular once per hour during 30 ms. When this power supply is performed, the actuator emits an electric signal which is received by the diagnostic device and which enables the state of the actuator to be determined.

The diagnostic device 3 preferably comprises a power supply 31, control means 32, 36 of power supply of the actuator, monitoring means 33, 37 of electric characteristic of the electric signal supplying the actuator and means 38 for deduction of a diagnostic of the actuator.

The actuator power supply control means 32, 36 can comprise a first controlled switch 36 controlled by control means 36, for example included in a microcontroller 39.

The monitoring means or resistive element 33, 37 of the electric characteristic of the electric signal supplying the actuator can comprise resistive element 33, 37 for determining an intensity of the current flowing in line supplying the actuator or means 33 for determining a voltage at the terminals of a resistive element 37 through which the current flowing in the line supplying the actuator flows. Means 33 can be included in the microcontroller.

The means 38 for deduction of a diagnostic of the actuator can comprise means for time-based analysis of the variations of the electric characteristic of the electric signal supplying the actuator, in particular means for analysing the variations of the intensity of the current absorbed in the actuator in a time window. Means 38 may be included in the microcontroller.

For example, the controlled switch and resistive element are connected in series on the line supplying the actuator. They can be connected in series between the terminals 6.

Advantageously, the diagnostic device can comprise a user interface, such as a light indicator informing a user of the existence of a problem, in particular a problem of state of the actuator. Alternatively or complementarily, the diagnostic device can also comprise terminals 35 to which a user interface device can be connected.

A first embodiment of actuator 2 is described in the following with reference to FIG. 3. The actuator 2 mainly comprises a control device 22 and an electromagnet 21.

The electromagnet comprises for example a first inrush coil 211 and a second holding coil 212. The coils are for example connected in series.

The control device mainly comprises a converter 221 for converting the electric power supply signal of the actuator into an electric signal suitable for supply of the electromagnet, a logic processing unit 225 such as a microcontroller, a power supply 223 and a voltage regulator 224 to supply power to this logic processing unit, control means 225, 226 of the power supply of the first coil, control means 225, 228 of the power supply of the serially connected set of first and second coils, means 225, 227 for determining an intensity of the current flowing in the first coil, means 225, 229 for determining an intensity of the current flowing in the serially connected set of first and second coils, means 225 for analysing the intensities of the currents flowing in the coils, means 222 for determining a supply voltage of the coils and means for analysing the supply voltage of the coil.

The converter 221 220 typically comprises a protection circuit, a filter and a rectifying circuit.

Figure 3:
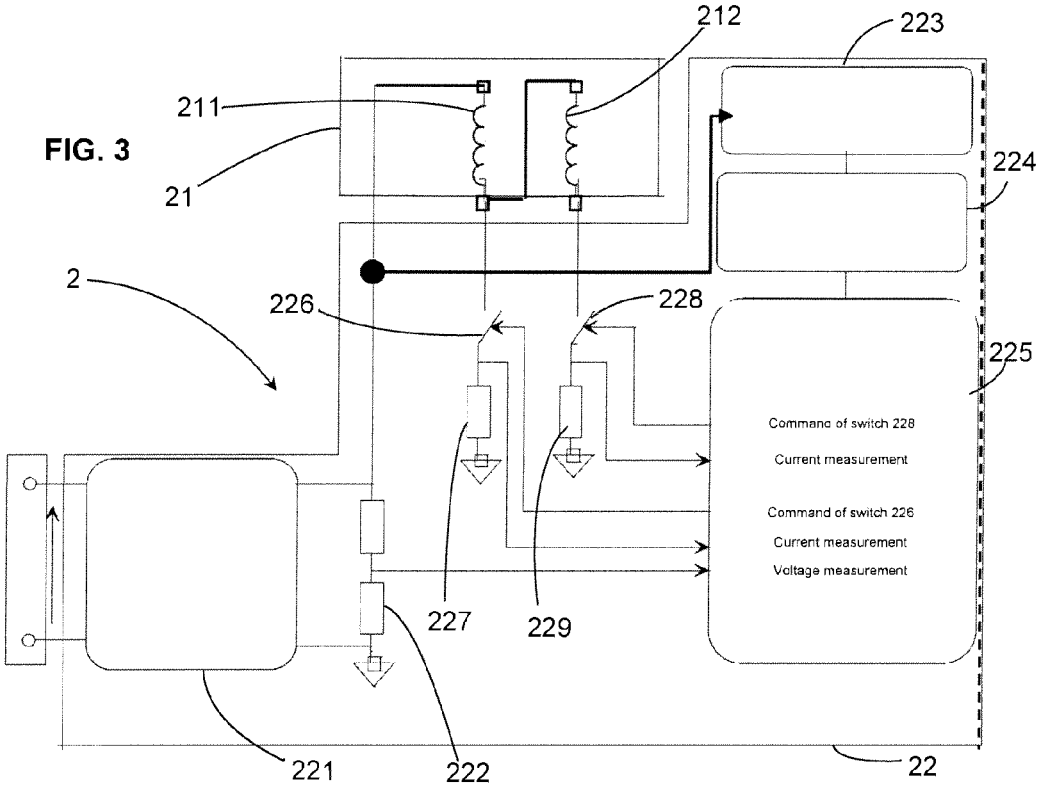
FIG. 3 is a diagram of a first embodiment of an actuator according to the invention.

Preferably, as represented in FIG. 3, the logic processing unit is supplied by the power supply 223 via the voltage regulator 224. The power supply is itself supplied by the output of the converter 221.

The means for determining the supply voltage of the coils comprise a voltage divider 222 the intermediate terminal of which attacks the logic processing unit.

The control means 225, 226 of the power supply of the first coil preferably comprise a switch 226 controlled by the logic processing unit 225. Likewise, the control means 228, 225 of the power supply of the serially connected set of first and second coils preferably comprise a switch 228 controlled by the logic processing unit 225.

The means 225, 227 for determining an intensity of a current flowing in the first coil 211 preferably comprise a resistor 227 connected in series with the first coil and the controlled switch 226. For example, one terminal of the resistor 227 is grounded. The potential of the other terminal of the resistor attacks an input of the logic processing unit.

The means 225, 229 for determining an intensity of the current flowing in the assembly comprising the first and second coils preferably comprise a resistor 229 connected in series with the first and second coils and the controlled switch 228. For example, one terminal of the resistor 229 is grounded. The potential of the other terminal of the resistor attacks an input of the logic processing unit.

This second embodiment of control device is preferably designed to be applied when the voltage on output from the converter 221 remains below a first voltage threshold, for example 100 V.

Figure 4:
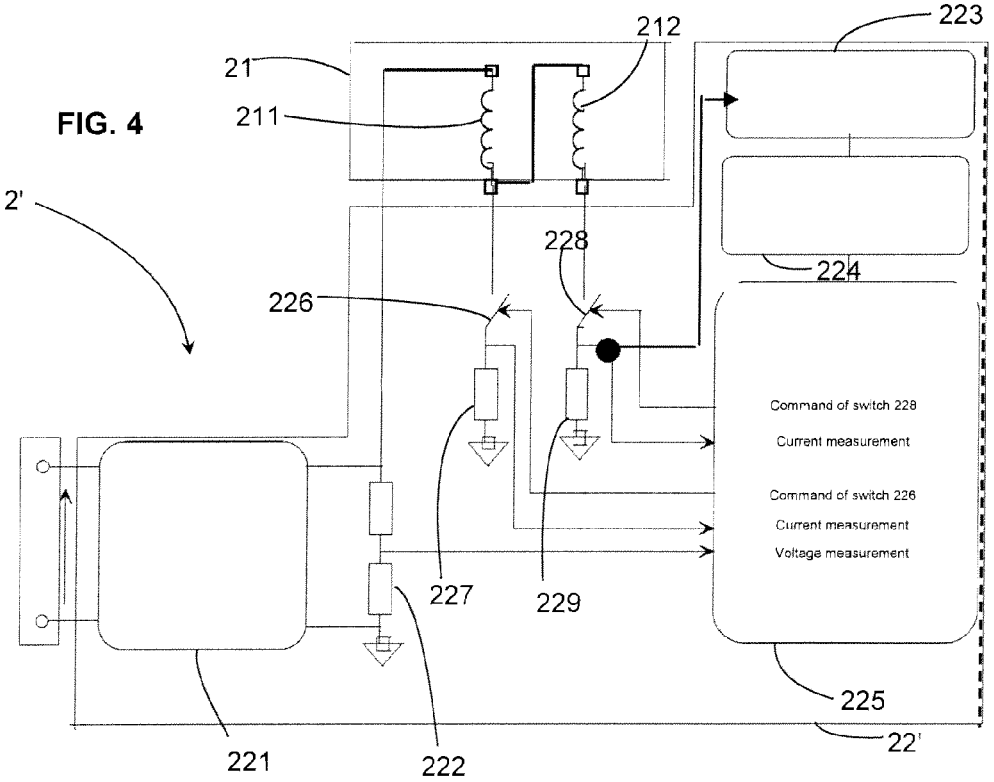
FIG. 4 is a diagram of a second embodiment of an actuator according to the invention.

A second embodiment of actuator 2' is described in the following with reference to FIG. 4. Actuator 2' differs from actuator 2 in that it comprises a different control device 22'. Control device 22' in fact differs from control device 22 in that the power supply 223 is supplied between the terminals of a resistive element, in particular between the terminals of the measuring resistor 229. This second embodiment of control device is preferably designed to be applied when the voltage on output from the converter 221 exceeds a first voltage threshold, for example 100 V.

Figure 5:
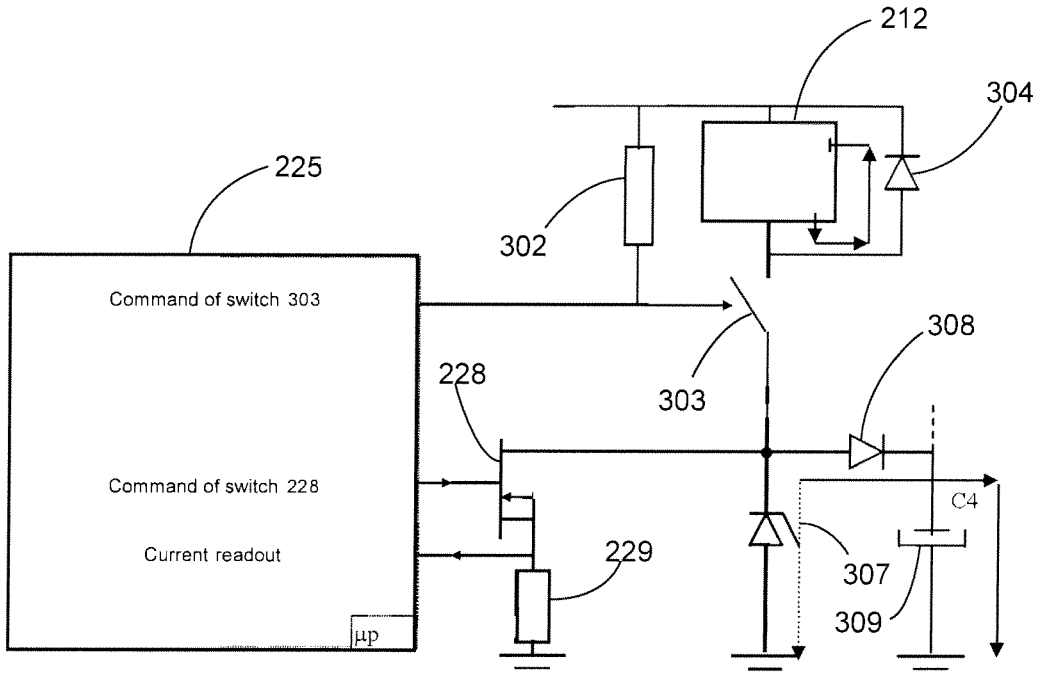
FIG. 5 is a diagram of a variant of the second embodiment of a control device according to the invention.

A detail of embodiment of the control device according to the second embodiment is described in the following with reference to FIG. 5.

In this embodiment, a controlled switch 303 is connected in series with the holding coil 212 and a Zener diode 307 between the terminals of the converter 221. A series connection of a diode 308 and capacitor 309 is further connected in parallel to the Zener diode. A series connection of the controlled switch 228 and measuring resistor 229 is also connected in parallel to the Zener diode. The controlled switch 303 is connected to the logic processing unit 225 and to an output terminal of the converter 221 via a pull-up resistor 302. In this way, as soon as the converter 221 supplies a voltage, the controlled switch 303 is closed. A diode 304 is connected in parallel to the holding coil.

The controlled switch 228 is further controlled by the logic processing unit 225 and therefore enables the Zener diode to be short-circuited to measure the current flowing in the holding coil 212, at the level of the resistor 229. It can be noted that the diode 308 prevents a current supplied by the capacitor 309 from flowing in the resistor 229 when the controlled switch 228 is closed.

Such an assembly enables the voltage developed at the terminals of the Zener diode to charge the capacitor 309 to produce an electric signal providing the necessary power for power supply 223.

For example, in the scope of permanent control, the logic processing unit can regulate the supply current of the holding coil regularly, for example every 312 μs: the switch 303 being closed, the current simply has to be branched off to the resistor 229 by the controlled switch 228 for a short time (typically 16 μs) to know the value of the current intensity. If the latter is lower than a setpoint, the controlled switch 303 is kept on and the current flows in the Zener diode 307 and in the capacitor 309. If the holding coil presents a problem, the logic processing unit can command opening of the controlled switch 303.

The diagnostic device and/or the control device comprise(s) all the hardware and/or software means enabling the diagnostic method that is the object of the invention to be implemented. In particular, the diagnostic device and/or the control device comprise(s) the hardware and/or software means enabling each of the steps of the diagnostic method that is the object of the invention to be implemented. These means can include computer programs.

Figure 6:
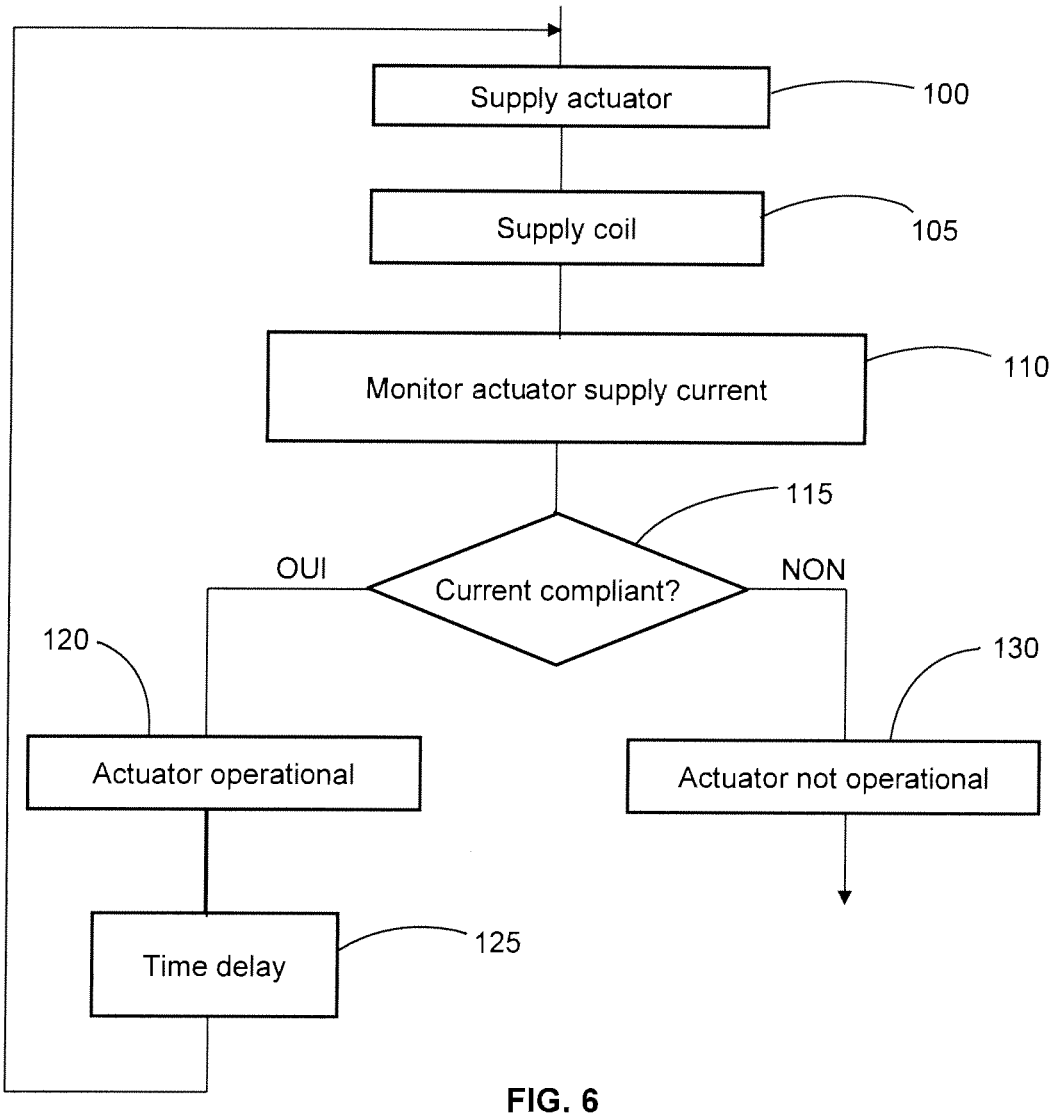
FIG. 6 is a flowchart of a mode of execution of the diagnostic method according to the invention.

A mode of execution of a diagnostic method according to the invention is described in the following with reference to FIG. 6. Preferably, the set of steps of the method described in the following are iterated in time, in particular at regular intervals. These iterations are preferably commanded by a clock included in the diagnostic device.

In a first step 100, supply of the actuator is commanded by means of the diagnostic device. This command is preferably triggered by a clock and maintained during a predefined time, for example 30 ms. In the embodiment of diagnostic device described in the foregoing, this power supply step is performed by closing of the controlled switch 36. The actuator 2 is then supplied by the power system via the resistor 37. It should be noted that at the end of the predefined time mentioned above, the controlled switch 36 is opened.

In a second step 105, power supply of a coil is commanded by means of the control device of the actuator. This is preferably performed automatically at the level of the actuator in a test procedure recorded in the logic processing unit 225 and implemented when power supply of the actuator is performed. To do this, the logic processing unit commands closing of controlled switch 226. As from this moment, a supply current of coil 211 flows through the controlled switch 226 and resistor 227. This step can also comprise power supply of the set of coils 211 and 212. To do this, the logic processing unit commands closing of controlled switch 228. As from this moment, a supply current of coil 212 flows through the controlled switch 228 and resistor 229. The supply current or currents of the coils can be detected at the level of the diagnostic device, and more exactly at the level of the resistor 37 of the diagnostic device. Power supply of a coil or of the coils in fact results in a larger current inrush on the power supply line of the actuator 2.

In a third step 110, an electric characteristic of the electric signal supplying the actuator is monitored or analysed at the level of the diagnostic device. The intensity of the electric current supplying the actuator is preferably monitored, in particular the variation of the intensity of the electric current supplying the actuator is monitored throughout the time during which the actuator is supplied via the diagnostic device.

In a fourth step 115, a test is made of whether variations or modifications of a characteristic, in particular the intensity of the electric current supplying the actuator, comply with what they should be in case of satisfactory operation of the actuator. The actuator is in fact designed to absorb an electric current having a calibrated intensity in the course of a test procedure. If the intensity of the electric current absorbed by the actuator strays away from this calibrated value, it can be deduced therefrom that the actuator presents a fault, in particular at the level of its coils and/or a fault at the level of the control device of power supply of its coils. Following this test step, a diagnostic of the actuator is deduced using a result of the monitoring or analysis step.

If the result of the test step 115 is positive, we go on to a step 120 in which the following diagnostic is established: the actuator is operational. We then go on to a step 125 during which a time delay is performed before looping back to step 100. The time delay of step 125 is preferably relatively long, typically about one hour. The diagnostic can be displayed via an interface.

If the result of the test step 115 is negative, we go on to a step 130 in which the following diagnostic is established: the actuator is not operational. A step of analysis of the variations of the electric characteristic can in particular be implemented to determine which part of the actuator is not operational, in particular the control device or the inrush coil or the holding coil. The diagnostic can be displayed via an interface.

An example of variations of the intensity of the electric current supplying an operational actuator is described in the following with reference to FIG. 2.

In the top diagram, the variation versus time of the voltage V7 at the terminals of the actuator when executing the mode of execution of the diagnostic method according to the invention is represented. It can be noted that the actuator is supplied for 30 ms.

In the bottom diagram, the variation versus time of the voltage V37 at the terminals of the resistor 37 of the diagnostic device is represented, this voltage being an image of the supply current of the actuator. In an example embodiment, after it has supplied power to the actuator for 20 ms, the power supply control device commands a brief closing of the first controlled switch 226 and then of the second controlled switch 228. The total closing time of these switches is typically about 2 ms. Between the beginning of power supply of the actuator and the end of power supply of these coils, the logic processing unit 225 has for example verified that:

- the supply voltage of the actuator is sufficient to activate the latter by means of measurement of the voltage between the two resistors of the voltage divider 222,
- the power supply of the logic processing unit 223 is operational,
- the electric current flowing in the inrush coil is neither too low (case of an open circuit) nor too high (case of a short-circuit). Measurement of the voltage at the terminals of resistor 227 can be used for this purpose.
- the electric current flowing in the holding coil is neither too low (case of an open circuit) nor too high (case of a short-circuit). Measurement of the voltage at the terminals of resistor 229 can be used for this purpose.

If all these conditions are fulfilled, the control device transmits the result of these verifications. To do this, the logic processing unit commands for example closing of the controlled switch 226 during a brief period, for example 1 ms. In the opposite case, the logic processing unit does not command closing of the controlled switch supplying one or the other of the coils.

Figure 2:
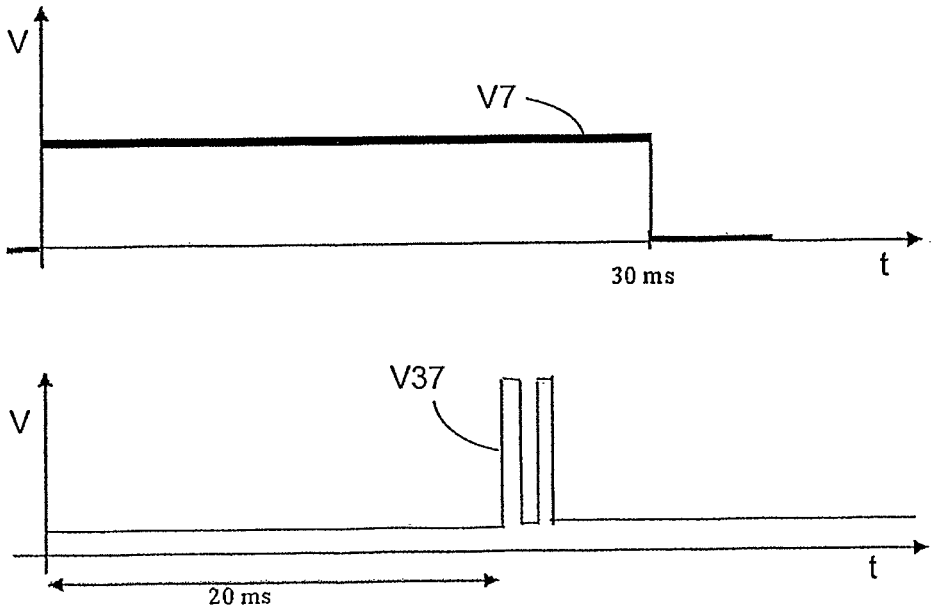
FIG. 2 is a time-based diagram of the test signals.

Consequently, when the voltage at the terminals of resistor 37 of the diagnostic device is analysed, as represented in FIG. 2, two successive pulses are seen to occur when the actuator is operational and a single pulse or even no pulses are seen when the actuator is faulty.

The test steps of current flow in the coils can naturally be arranged differently in time. Likewise the switching operations enabling the result of the tests carried out at the level of the actuator to be encoded can be arranged differently in time and be varied so as to be able to encode different information such as failure of the control device, failure of the inrush coil and failure of the holding coil.

The control device is further such that if the voltage continues for more than 30 ms at the terminals of the actuator, it interprets this power supply as an operational power supply and not as a diagnostic procedure. It then commands a power supply step of the inrush coil, at the end of the 30 ms, for example for 80 ms, followed by power supply of the holding coil, the inrush coil being deactivated.

In a preferred alternative embodiment, testing of the holding coil is performed implicitly by the fact that the power supply of the logic processing unit flows via the holding coil in the case of actuator 2'. If it is interrupted, nothing works. Furthermore, in the case of actuator 2, the state of the holding coil cannot be tested. The functionality of the inrush coil can in fact suffice to perform the function of the actuator.

Thus, due to the invention, it is possible to test the control electronics of the actuator, the correctness of the wiring, the presence of supply voltage, and the state of the coil(s) by means of the diagnostic device.

The resistance values of the coil or coils can also be determined precisely due to knowledge of the supply voltage of the coils. It is also possible, by adding a temperature sensor, to be able to correct the resistance measurement to take account of its temperature fluctuation.

Naturally, the information feedback from the actuator to the diagnostic device can be achieved by means of conductors distinct from the conductors performing power supply of the actuator.

The different controlled switches can be achieved by means of transistors.

The invention claimed is:

1. A diagnostic method for an actuator which comprises a coil and a control device dedicated for supplying electric power to the coil, said method comprising:

- controlling electric power being supplied to an actuator by a diagnostic device which is physically separate from the control device of the actuator,
- controlling a supply of power to the coil of said actuator by a control device,
- monitoring the electric power being supplied to the actuator, and
- deriving a diagnostic indicator of the actuator from a result of the monitoring.

2. The diagnostic method according to claim 1, wherein controlling the power being supplied to the actuator comprises activating the control device.

3. The diagnostic method according to claim 1, wherein controlling the supply of power to the coil comprises activating the control device for supplying power to the coil.

4. The diagnostic method according to claim 1, wherein monitoring the electric power comprises determination of an intensity of a current flowing in a power supply line for the actuator, or determination of a voltage at the terminals of a resistive element through which current is flowing in a power supply line for the actuator.

5. The diagnostic method according to claim 1, wherein deriving a diagnostic indicator of the actuator comprises time-based analysis of variations of the electric power.

6. A diagnostic device for a supply of power to a coil of an actuator, comprising hardware or software means for implementing the diagnostic method according to claim 1.

7. The diagnostic device according to claim 6, wherein the hardware or software means comprise control means for a power supply of the actuator.

8. The diagnostic device according to claim 6, wherein the hardware and/or software means comprise means for determining an intensity of a current flowing in a power supply line for the actuator, or means for determining a voltage at the terminals of a resistive element through which the current is flowing in a power supply line for the actuator.

9. The diagnostic device according to claim 6, wherein the hardware or software means comprise means for deduction of a diagnostic of the actuator by time-based analysis of variations of the electric power.

10. The diagnostic device according to claim 6, wherein the hardware or software means comprise means for controlling a supply of power to the coil.

11. The diagnostic device according to claim 6, wherein the hardware or software means comprise means for determining an intensity of a current flowing in the coil, and means for analyzing the intensity of the current flowing in the coil.

12. The diagnostic device according to claim 6, wherein the hardware or software means comprise means for determining a supply voltage to the coils, and means for analyzing the voltage of power supplied to the coil.

13. An actuator comprising a coil and at least one control device comprising a diagnostic device according to claim 6.

14. The actuator according to claim 13 wherein the diagnostic device comprises two separate devices, namely: a first diagnostic device and a second control device.

15. A computer program comprising computer program code for execution on a computer of the method according to claim 1.

* * * * *